United States Patent [19]

Gordon

[11] 4,065,940

[45] Jan. 3, 1978

[54] TOE RING BASE AND ORNAMENTAL TOE RING

[76] Inventor: Murray A. Gordon, 7357 Denny Ave., Sun Valley, Calif. 91352

[21] Appl. No.: 695,739

[22] Filed: June 14, 1976

[51] Int. Cl.[2] ..... A44C 15/00

[52] U.S. Cl. ..... 63/2; 63/29 R

[58] Field of Search ..... 63/2, 15, 15.6; 128/81 R, 133

[56] References Cited

U.S. PATENT DOCUMENTS

| | | | |
|---|---|---|---|
| D. 151,789 | 11/1948 | Shapiro | 63/15 UX |
| 1,601,560 | 9/1926 | Codman | 63/1 UX |
| 2,084,343 | 6/1937 | Jefferls | 63/1 UX |
| 2,163,012 | 6/1939 | Schenk | 128/81 R |
| 2,603,212 | 7/1952 | Zeve | 128/81 R |
| 3,712,271 | 1/1973 | Greathouse | 128/81 R |

FOREIGN PATENT DOCUMENTS

| | | | |
|---|---|---|---|
| 500,021 | 11/1954 | Italy | 63/2 |

*Primary Examiner*—F. Barry Shay

*Attorney, Agent, or Firm*—Keith D. Beecher

[57] ABSTRACT

A toe ring base is provided, to be worn between two adjacent toes of the wearer, and capable of supporting one or more ornaments. In one embodiment the toe ring is formed of one piece of gold, silver, plastic, or the like, and it comprises a pair of arcuate-shaped open crescent-like members formed in back-to-back relationship and having a common inclined central portion adapted to fit between two adjacent toes of the wearer and to extend over the inclined web of flesh between the toes, the arcuate-shaped members further having upper and lower respective end portions shaped to extend partially around the respective toes. The central portion of the toe ring base has substantial width to prevent twisting of the ring base between the toes, and the upper end portions of the arcuate-shaped crescent-like members forming the ring base are positioned to the rear of the lower end portions and over the top surface of the toes and the foot immediately in back of the toes. One or more mounts to receive decorative ornaments are integrally or removably mounted on the ring base.

9 Claims, 6 Drawing Figures

FIG. 4
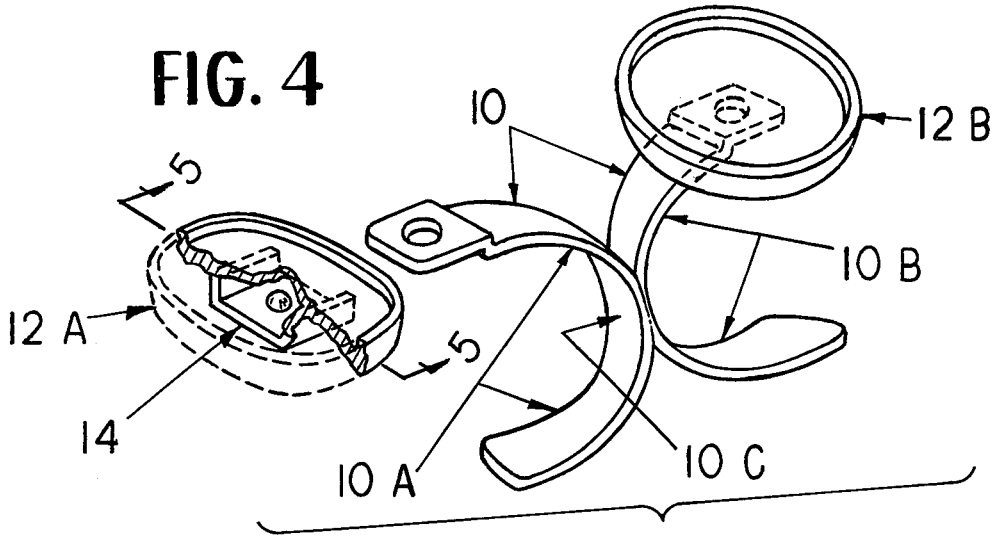
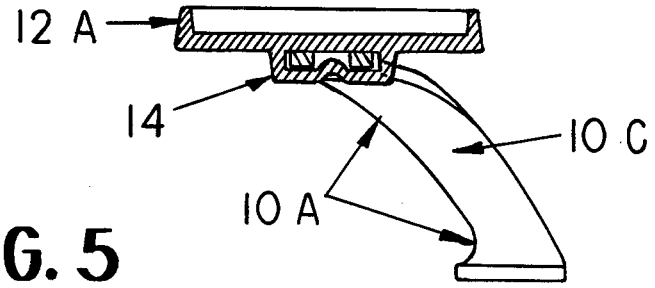
FIG. 5
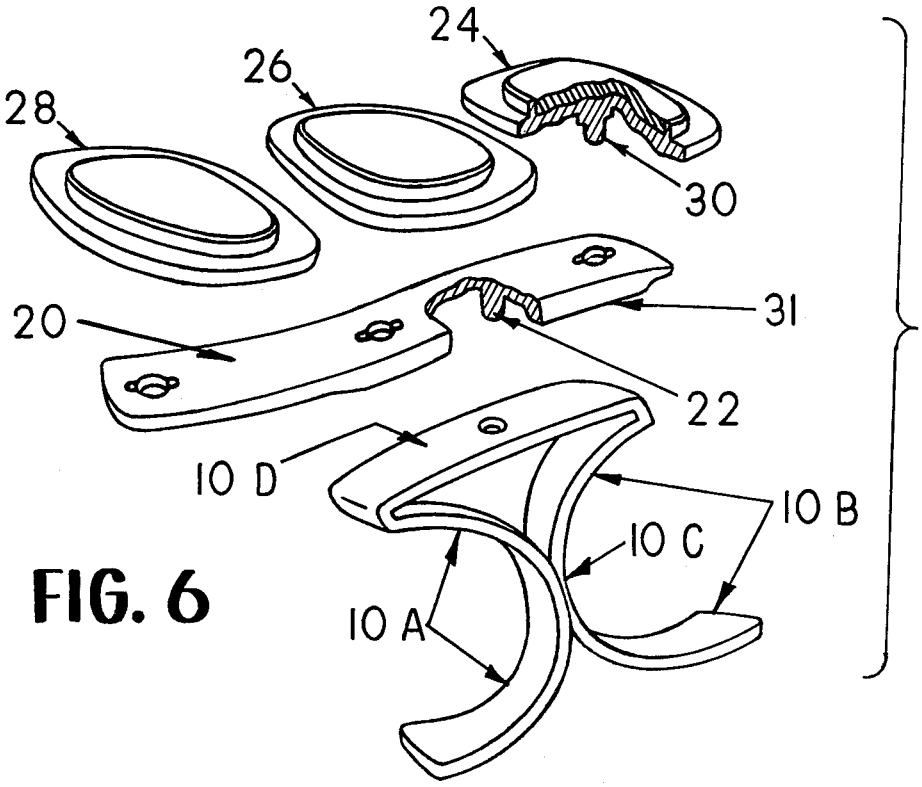
FIG. 6

TOE RING BASE AND ORNAMENTAL TOE RING

BACKGROUND OF THE INVENTION

The present invention is concerned with a toe ring which, in one embodiment comprises a sculptured form of any appropriate material which, when fitted between the toes of the wearer in the manner to be described, enables the wearer while wearing only one toe ring base to show off one or several decorative ornaments, similar to and resembling one or more decorative ornaments used to embellish one prior art ring or several prior art rings worn on the fingers of the hand at the same time. The sculptured form of the toe ring base is shaped so that it may comfortably be worn between the toes of the wearer without any tendency for the toe ring base to twist or to fall off. Any appropriate ornament, or ornaments seated in a mount may be integral with or a removable part of the toe ring base, and such ornaments, for example, may be precious, semi-precious or non-precious gem stones, metal, or other appropriate materials used in the jewelry industry.

The position considered as most appropriate for the fitting and wearing of the toe ring base or the toe ring of the invention is between the second and third toes of either foot, as will be shown in the accompanying drawings. However, it will become evident as the description proceeds, that the toe ring may be worn between other toes of the foot, if so desired. The anatomy of the second and third toes and their interconnecting inclined web of flesh offers upper and lower surfaces which are approximately perpendicular to the direction of the extension of the toes from the foot, wherein both the top and underside of the second and third toes may be fitted most comfortably with the toe ring base, as will be described.

The toe ring base of the invention is constructed to overcome the anatomical problem which arises because of the differences between the human toe and the human finger. Unlike the finger, the toe has an enlarged extremity and a narrow base. This precludes any possibility of wearing an annular-type of finger ring on the toe, since it is virtually impossible to design an annular ring which will slip over the end of the toe, and yet which can be worn comfortably at the base of the toe without it being poorly fitted in that position. If a clamp-like band is used in an attempt to overcome this problem, the band introduces two pieces of material between the toes, (i.e., one on either side of a toe) and there is normally insufficient room between the toes to permit such a band to be worn comfortably. Also, complications are presented when the wearer attempts to unclamp the band when it is desired to remove such a toe ring.

The toe ring base of the present invention, as will be described, consists of a pair of arcuate-shaped open crescent-like members formed in back-to-back relationship and having a common central portion. The common central portion may be constructed relatively thin, and is inclined in a parallel direction to the extension of the toes from the foot, so that it can fit between the two adjacent toes of the wearer to be worn comfortably; and the common central portion may be made sufficiently wide in a parallel direction to the extension of the toes of the foot, so as to prevent any twisting of the toe ring about the centerline axis of the common central portion of the toe ring base. Also, as will be described, the arcuate-shaped open crescent-like members comprising the toe ring base are constructed so that they may be firmly retained between the toes, in proper position to receive an appropriate ornament on the upper end thereof. If so desired, several separate ornaments may be mounted on the toe ring base to provide an appearance, while using only one toe ring base, corresponding to that of the wearing of several rings at the same time.

Briefly stated, the toe ring base of the invention, in the embodiments to be described, is formed of one piece of sculptured metal, or other appropriate material, which is shaped to fit between two adjacent toes of the wearer. Although in the embodiments to be described the toe ring is formed of one piece of sculptured material, the upper or lower end portions may be adjusted to the diameters of the toes of the particular wearer. Moreover, it will become apparent as the description proceeds that the toe ring base may be formed of two or more pieces to permit similar adjustments to be made so as to conform to different diameters of the toes at the point where the toe ring base is seated into the wearing position.

The shape of the toe ring base of the invention allows for maximum strength of material between the toes with a relatively thin cross-section at the common central portion, so that the toes are not separated to a point which will cause the wearer any discomfiture. As described above, one or more pieces of jewelry, or other ornaments, may be mounted on the top of the toe ring base. If more than one jewelry mount is mounted on the toe ring base, it is preferable that care be taken to distribute the weight of the jewelry mounts and the decorative ornaments they carry more or less equally on either side of the common center portion of the toe ring base, so that there will be no tendency for the toe ring to twist about its common center portion with resulting discomfiture to the wearer.

BRIEF DESCRIPTION OF THE DRAWINGS

FIG. 4 is a perspective view of the embodiment of FIG. 1 on a somewhat enlarged scale, and showing two mounts which may receive decorative ornaments fixed to the top of the toe ring base, with one of the mounts shown detached, for purposes of clarity;

FIG. 5 is a sectional view taken substantially along the line 5—5 of FIG. 4, and showing the manner in which a jewelry mount may be permanently or removably attached to the toe ring base; and FIG. 6 is a perspective view, like FIG. 4, of a modified construction of the toe ring base showing three mounts and decorative ornaments.

DETAILED DESCRIPTION OF THE ILLUSTRATED EMBODIMENTS

Figure 1:
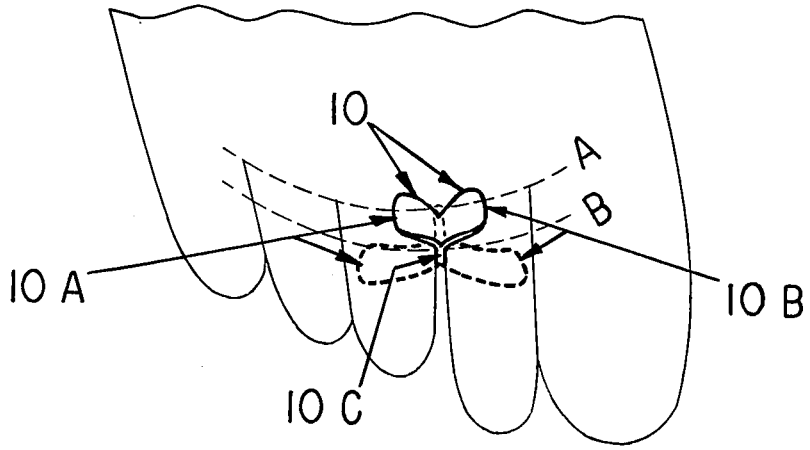
FIG. 1 is a top plan view showing a toe ring base constructed in accordance with one embodiment of the invention and worn between the second and third toes of a wearer.
Figure 2:
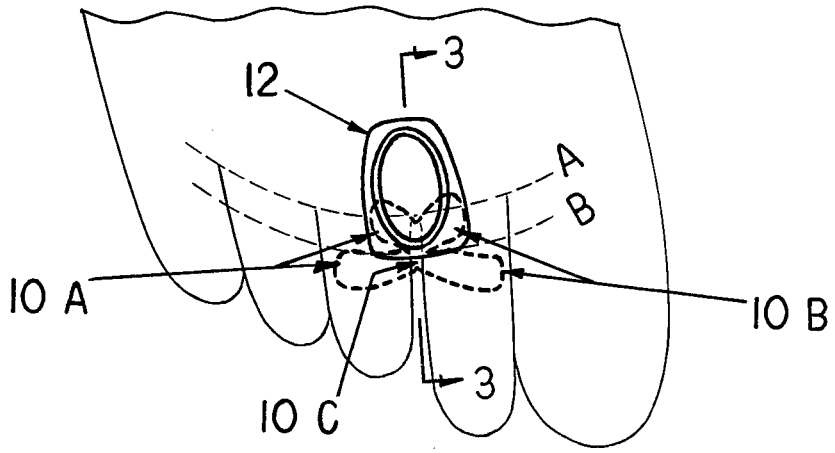
FIG. 2 is a top plan view of the toe ring base of FIG. 1, with one mount and decorative ornament fixed to the top of the toe ring base.
Figure 3:
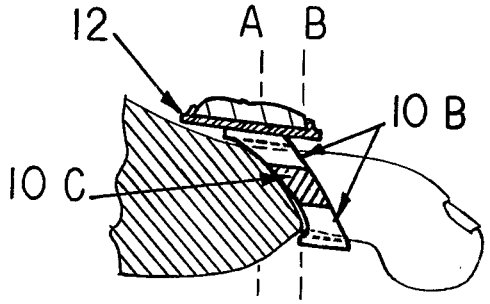
FIG. 3 is a section taken along the common center line 3—3 of the toe ring base of FIG. 2.

The toe ring base of FIGS. 1–4 is indicated generally as 10. The toe ring base 10, as best shown in FIG. 4, consists of a pair of arcuate-shaped open crescent-like members 10A and 10B formed in back-to-back relationship and having an inclined common central portion 10C which is adapted to fit between two adjacent toes of the wearer, as shown in FIGS. 1–3. The arcuate-shaped members 10A and 10B have upper and lower end portions which are shaped to extend partially around the corresponding toes, the upper portion also resting partially on the foot, as best shown in FIG. 1

As shown in FIGS. 1–4, the central portion 10C of the toe ring base has a substantial width in a parallel direction to the extensions of the toes from the foot, so as to prevent any twisting of the toe ring base about this center line axis of the toe ring base. Also, the upper end portions of the arcuate-shaped open crescent-like members 10A and 10B are positioned to the rear of the lower end portions, as shown in FIG. 1, so that the common center portion of the ring base lies on and is somewhat in contact with the inclined surface of the web of flesh between the toes, as shown in FIG. 3. In this way, the toe ring of the invention may be worn comfortably between the toes, and it does not have any tendency to fall off.

A jewelry mount 12 (FIGS. 2 and 3) may be fixed to the upper end portions of the arcuate-shaped open crescent-like members 10A and 10B, as an integral part of the toe ring base or added by means of metal solder or other adhesive appropriate for the material from which the mount 12 and toe ring base are made, and any appropriate ornament, such as a precious or semi-precious jewel may be supported by or housed in the mount.

In the embodiment of FIG. 4, two separate jewelry mounts 12A and 12B are supported on the upper end portions of the arcuate-shaped members 10A and 10B. These jewelry mounts may be permanently fixed by the jeweler to the toe ring base after they are selected by the wearer as being desirably and appropriately paired.

For example, and as shown in FIG. 5, the jewelry mounts 12A or 12B may be fixed on the upper end of the arcuate member 10A or 10B by a rigid bracket 14. The bracket 14 is an integral part of the underside of the jewelry mount, and a portion of the bracket is indented into a hole in the corresponding arcuate-shaped member to secure the mount to the toe ring base.

The forward and rear edges 10C of the common central portion of the arcuate-shaped open crescent-like members 10A and 10B may be rounded for comfort and for ease in fitting the toe ring base between the toes of the wearer. The toe ring base itself may be formed of an appropriate material, so that the arcuate-shaped open crescent-like members 10A and 10B may be adjusted so that they can be set to fit a wide variety of toe sizes. Alternately, toe ring bases of different sizes may be provided for different wearers.

The dotted lines A and B in FIGS. 1—3 represent the upper rear and lower forward edges of the web of flesh between the toes of the wearer. As shown in FIGS. 1–3, the common central portion 10C of the toe ring 10 is formed to fit over the upper surface of the web of flesh between the toes of the wearer, to cause the upper end portions of the arcuate-shaped open crescent-like members 10A and 10B to be positioned to the rear of the lower end portions, so that the toe ring base may be firmly and comfortably supported over the web of flesh between the toes by the top of the toes and partially by the top of the foot immediately behind the toes.

In the embodiment of FIG. 6, an integral bridge 10D is provided spanning the upper end portions of the arcuate-shaped open crescent-like members 10A and 10B. A separate mounting bar 20 is mounted on bridge 10D by means for example, a mounting post 22, the post 22 being received in a hole in strip 10D. A plurality of different jewelry mounts 24, 26, 28, and more, may be mounted on the bar 20 by means, for example, of a keyed mounting post 30 projecting from the underside of each mount and received in a corresponding keyed hole in the bar 20 to prevent their turning in position when seated in the mounting hole of the bar 20.

The mounting post 22 and 30 may be threaded posts which are locked into position by a nut from the underside of bar 20, or from the underside of bridge 10D respectively, or the mounting post may be peened, as one would a rivet, after insertion of the posts into their respective mounting holes. This does not preclude the use of any other means for locking the jewelry mount to the bar 20 or the mounting bar 20 to the bridge 10D.

A lip 21 is provided on the mounting bar 20 to serve as another type of keying device engaging the edge of the bridge 10D which prevents the bar 20 from revolving while in its seated position.

The invention provides, therefore, an ornamental toe ring which may comfortably and securely be worn between two adjacent toes of the wearer.

It is to be noted that although particular embodiments of the invention have been shown and described, modifications may be made. It is intended in the claims to cover the modifications which come within the true spirit and scope of the invention.

What is claimed is:

1. A toe ring base to be worn between two adjacent toes of the wearer, said toe ring base comprising: a pair of arcuate-shaped open crescent-like members formed in back-to-back relationship and having an inclined common central portion adapted to fit between two adjacent toes of the wearer and over the upper surface of the interconnecting inclined web of flesh therebetween, and further having respective upper and lower end portions shaped to extend across the upper surface and lower surface only of the same two adjacent toes of the wearer, and with the upper portion also partially resting on the foot immediately behind the toes, the central portion having substantial width in a parallel direction with respect to the extension of the toes to prevent twisting of the toe ring base between the toes, and the upper end portions of the arcuate-shaped members being positioned to the rear of the lower end portions.

2. The toe ring base defined in claim 1, in which the arcuate-shaped members are formed of one piece of a selected material.

3. The toe ring base defined in claim 1, in which the arcuate-shaped members are formed of a plurality of pieces of a selected material.

4. The toe ring base defined in claim 1, in which the inclined common central portion of the arcuate-shaped members has a rear edge adapted to contact the web of flesh between the toes of the wearer, and in which the central portion also has a forward edge.

5. The toe ring base defined in claim 1, and which includes at least one jewelry mount affixed to at least one of the upper end portions of the arcuate-shaped members.

6. The toe ring base defined in claim 1, and which includes at least one ornament affixed to at least one of the upper end portions of the arcuate-shaped members.

7. The toe ring base defined in claim 1, and which includes a bridge member spanning the upper end portions of the arcuate-shaped members.

8. The toe ring base defined in claim 7, and which includes at least one decorative ornament affixed to the bridge member.

9. The toe ring base defined in claim 7, and which includes a jewelry mounting bar affixed to the bridge member, and at least one jewelry mount affixed to the mounting bar.

* * * * *